US008366305B2

(12) United States Patent
Saito

(10) Patent No.: US 8,366,305 B2
(45) Date of Patent: Feb. 5, 2013

(54) VEHICLE LAMP

(75) Inventor: Taku Saito, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 334 days.

(21) Appl. No.: 12/874,361

(22) Filed: Sep. 2, 2010

(65) Prior Publication Data

US 2011/0051446 A1 Mar. 3, 2011

(51) Int. Cl.
*H01R 33/00* (2006.01)

(52) U.S. Cl. ..... 362/549; 362/545; 362/548

(58) Field of Classification Search ..... 362/249.02, 362/249.1, 249.11, 545, 548, 549
See application file for complete search history.

(56) References Cited

U.S. PATENT DOCUMENTS 4,745,530 A * 5/1988 Farrell et al. ..... 362/549
5,529,535 A * 6/1996 Forish ..... 439/56
5,785,418 A * 7/1998 Hochstein ..... 362/373
5,803,579 A * 9/1998 Turnbull et al. ..... 362/516
8,186,848 B2 * 5/2012 Lim et al. ..... 362/231

FOREIGN PATENT DOCUMENTS

JP 2002-93500 A 3/2002

* cited by examiner

*Primary Examiner* — Anabel Ton
(74) *Attorney, Agent, or Firm* — Kenealy Vaidya LLP

(57) ABSTRACT

A vehicle lamp using an LED optical unit can include a connector. The LED optical unit can include a circuit board upon which an LED is mounted, a shield plate including lock grooves and a connector including terminal members and engaging portions. Each of the terminal members can contact with conductor pads of the circuit board with confidence using an elastic force of the terminal members, while each of the engaging portions is engaged with the lock grooves via insert slits in the circuit board and the shield plate. The connector can be attached to the circuit board by inserting the engaging portions into the insert slits and by rotating the connector. The LED can receive power supply via the conductor pads and can emit variously-colored lights. Thus, vehicle lamps can be used for various vehicles with a simple structure by using the disclosed LED optical unit including connector.

20 Claims, 13 Drawing Sheets

VEHICLE LAMP

This application claims the priority benefit under 35 U.S.C. §119 of Japanese Patent Application No. 2009-202756 filed on Sep. 2, 2009, which is hereby incorporated in its entirety by reference.

BACKGROUND

1. Field

The presently disclosed subject matter relates to an LED optical unit using an LED light source and vehicle lamps including the LED optical unit, and more particularly to vehicle lamps including a reliable LED optical unit having a connector which is mounted on a printed circuit board to receive a power supply from an external battery.

2. Description of the Related Art

Recently, various vehicle lamps using an LED light source have been developed. In the vehicle lamps, the LED light source and peripheral components are frequently assembled as an LED optical unit, which is attached to a predetermined position of a housing along with other components to form a single component in order to improve workability and provide other benefits.

In a manufacturing process for such an LED optical unit, an LED and printed circuit components that compose an LED driving circuit are soldered on a printed circuit board, for example, in a reflow process. After that, a connector for providing the printed circuit board with a power supply from an external battery is attached to the printed circuit board. In addition, a heat sink is frequently attached to a rear side of the printed circuit board via screws to reduce a junction temperature of the LED.

FIG. 12*a* is a front view showing a conventional attachment structure of a connector mounted on a printed circuit board, and FIGS. 12*b* and 12*c* are perspective views showing a connecting state of the connector and the coupler and a disconnecting state thereof, respectively. As shown in FIG. 12*a*, the connector 102 is attached to the printed circuit board 100 via screws 104. Terminals 102A, 102B and 102C of the connector 102 are electrically connected to conductor patterns of the printed circuit board 100 via a solder as shown in FIG. 12*b*. In this case, a coupler 106 is attachable to the connector 102 that is mounted on the printed circuit board 100 as shown in FIG. 12*c*.

Another conventional attachment structure for a connector is shown in FIG. 13 and is configured as an attachment structure for a connector mounted on a printed circuit board that is disclosed in patent document No. 1 (Japanese Patent Application Laid Open JP2002-93500). The conventional connector 90*a* includes an insulating housing 93, which includes contact plates 97 and 98 and hooks 99. The insulating housing 93 is attached to a printed circuit board 94 by the hooks 99 so that the printed circuit board 94 is sandwiched between the insulating housing 93 and the hooks 99.

In this case, while each of contact points 97*b* and 98*b* of the contact plates 97 and 98 contacts conductor patterns 95 and 96 on the printed circuit board 94, the contact plates 97 and 98 extend between the insulating housing 93 and the printed circuit board 94 and create elastic forces such that the connector 90*a* separates from the printed circuit board 94. Accordingly, the connector 90*a* can be attached to the printed circuit board 94 without screws and/or solder.

For example, when a card 90*b* having electrodes 91 and 92 is inserted between the contact plates 97 and 98 of the connector 90*a*, each of the electrodes 91 and 92 of the card 90*b* can be electrically connected to the conductive patterns 95 and 96 of the printed circuit board 94 via conductor portions 97*a* and 98*a* of the contact plate 97 and 98 of the connector 90*a*.

The above-referenced Patent Document is listed below and is hereby incorporated with its English abstract in its entirety.

1. Patent document No. 1: Japanese Patent Application Laid Open JP2002-93500

By using the above-described conventional attachment structure used in the connector 90*a* in an LED optical unit, the connector 90*a* may be attached to a printed circuit board without screws and/or solder. However, when the LED optical unit is used for a vehicle lamp, the LED optical may be subject to large vibrational forces. Accordingly, the contact points 97*b* and 98*b* are often attached to the conductor patterns 95 and 96 via solder, and thereby may be electrically connected to the conductor patterns 95 and 96 with confidence.

However, a crack may be caused in the solder portions because the connector 90*a* is also often used under high temperature conditions due to heat generated from LEDs. Therefore, as shown in FIG. 12*a*, a connector 102 can be attached to a printed circuit board 100 via screws 104. However, the conventional attachment structure shown in FIG. 12*a* may result in added cost because it increases the number of parts and the number of assembly processes.

After the terminals 102A-102C of the connector 102 are soldered along with the other components in a reflow process, and when the connector 102 is attached to the printed circuit board 100 via screws 104, a crack may be caused in the soldering portions due to the screwing force during assembly. Consequently, after the connector 102 is attached to the printed circuit board 100 via the screws 104, the terminals 102A-102C of the connector 102 may be soldered to the conductor patterns of the printed circuit board 100 by hand work. Therefore, the conventional attachment structure may result in a complex manufacturing process.

In contrast, by using the conventional attachment structure in which connector 90*a* shown in FIG. 13 is used in an LED optical unit, the soldering process and the screwing process for attaching the connector 90*a* to the printed circuit board 94 may be eliminated. However, the large vibration of a vehicle may cause a loose connection between the electrodes 91, 92 and the conductor portions 97*a*, 98*a* and/or between the conductor patterns 95, 96 and the conductor points 97*b*, 98*b*. Moreover, in a worst case scenario, the connector 90*a* may become totally removed from the printed circuit board 94 due to the large vibration and/or the card 90*b* may become totally removed from the connector 90*a*.

The disclosed subject matter has been devised to consider the above and other problems, characteristics and features. Thus, an embodiment of the disclosed subject matter can include a vehicle lamp including an LED optical unit having a reliable connector that can be easily fixed and may not require the use of a screw and/or solder, and can be used in large vibration and shock conditions. In this case, the vehicle lamp can be constructed from only one optical unit that can be formed in a thin shape. Thus, the vehicle lamp can result in an increase in the possible range of vehicle lamp design options, and therefore can be employed for various vehicles including a small size car and a large size truck.

SUMMARY

The presently disclosed subject matter has been devised in view of the above and other characteristics, desires, and problems in the conventional art. An aspect of the disclosed subject matter can include providing thin LED optical units for various vehicle lamps, in which a connector can be easily fixed without a screw and/or solder, and can be used with high reliability even under large vibration and shock conditions. Another aspect of the disclosed subject matter can include providing vehicle lamps including the LED optical unit, which can be used for various vehicles with a simple structure.

According to one aspect of the disclosed subject matter, an LED optical unit can include a printed circuit board having an LED mounting surface and a plurality of insert slits, at least one LED having electrodes, a shield plate having a plurality of insert slits and an opposite surface, and a connector having a body and a plurality of terminal members. The LED mounting surface of the printed circuit board can include at least one pair of mounting pads and a plurality of conductor pads, and each of the at least one pair of mounting pads can be electrically connected to one of the plurality of conductor pads. The plurality of insert slits of the printed circuit board can penetrate into the printed circuit board and can be located around the plurality of conductor pads. The at least one LED can be mounted on the at least one pair of mounting pads and the electrodes thereof can be electrically connected to each of the at least one pair of mounting pads.

In addition, the plurality of insert slits of the shield plate can be formed in the same shape as those of the printed circuit board. The shield plate can be located adjacent to the printed circuit board so that the plurality of insert slits overlaps with the plurality of insert slits of the printed circuit board, and the opposite surface can include a plurality of lock grooves that is located adjacent to the plurality of insert slits of the shield plate. The plurality of lock grooves can be located toward the printed circuit board than the opposite surface of the shield surface. The body of the connector can include a front plate, a rear plate and a plurality of attachment portions that extends from the front plate toward the rear plate, and each of the attachment portions can include an engaging portion that is engaged with the lock groove of the shield plate. The plurality of terminal members can be located between the front plate and the rear plate, and each of the terminal members can include a cable connecting portion and a contact portion that is located so as to have an elastic force with respect to the front surface. Each of the contact portions of the terminal members can contact with one of the conductor pads of the printed circuit board, and wherein the connector is configured to be attached to the printed circuit board and the shield plate by the engaging portions of the attachment portions and using the elasticity of the contact portions of the plurality of terminal members.

According to another aspect of the disclosed subject matter, the LED optical unit can further include a heat sink that is located adjacent to the opposite surface of the heat shield plate and a projector lens having an optical axis, which is located adjacent to the heat shield plate so that the optical axis thereof substantially corresponds to an optical axis of the LED and the projector lens does not contact with the printed circuit board.

In the above-described exemplary LED optical units, the cable connecting portions of the connector can be directly connected to cables. The LED optical unit can further include guide surfaces that are located between each of the insert slits of the heat shield plate and each of lock grooves of the heat shield plate, wherein each of the guide surfaces is slanted toward each of the lock grooves. Each of the parts of the insert slits of the printed circuit board and the heat shield plate that is located adjacent to each of the guide surfaces can also be larger than the engaging portion of the connector so that the engaging portions of the connector can be removed from each of the insert slits of the printed circuit board and the heat shield plate. In addition, each of the insert slits of the printed circuit board and the heat shield plate can be formed in substantially arc shapes.

According to the above-described exemplary LED optical units, each of the contact portions of the connector can contact with the conductor pads with confidence using the large elastic forces caused by the terminal members. Therefore, a reliable connecting state between the contact portions and the conductor pads can be maintained even under large vibration and shock conditions. Moreover, each of the engaging portions of the connector can be engaged with the lock grooves of the heat shield plate by the above described large elastic forces. Therefore, the connector cannot be easily removed from the printed circuit board and the heat shield plate. Furthermore, the connector can be attached to the printed circuit board and the shield plate by inserting each of the attachment portions into the insert slits and by rotating the connector. Thus, the disclosed subject matter can provide reliable LED optical units having a connector, which can be easily attached to the printed circuit board and the shield plate without a screw and/or solder.

According to another aspect of the disclosed subject matter, a vehicle lamp including the LED optical unit can further include a housing and an outer lens that is located adjacent to the housing. The vehicle lamp can further include a fulcrum shaft having a fulcrum point that is located in the housing and is configured such that the LED optical unit is revolvable about the fulcrum point. The vehicle lamp can also include a first screw that is configured to rotate the LED optical unit in a first direction about the fulcrum point and a second screw that is configured to rotate the LED optical unit in a second direction about the fulcrum point, the first direction being substantially normal to the second direction.

In the above-described vehicle lamp including the LED optical unit, the vehicle lamp can be reduced in thickness because the cables can be connected to the reliable connector within the range of a thickness of the connector. In addition, the vehicle lamp can allow the LED optical unit to adjust a favorable light distribution pattern with the two screws. Thus, the disclosed subject matter can provide vehicle lamps that can be used for various vehicles with a simple structure.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1:
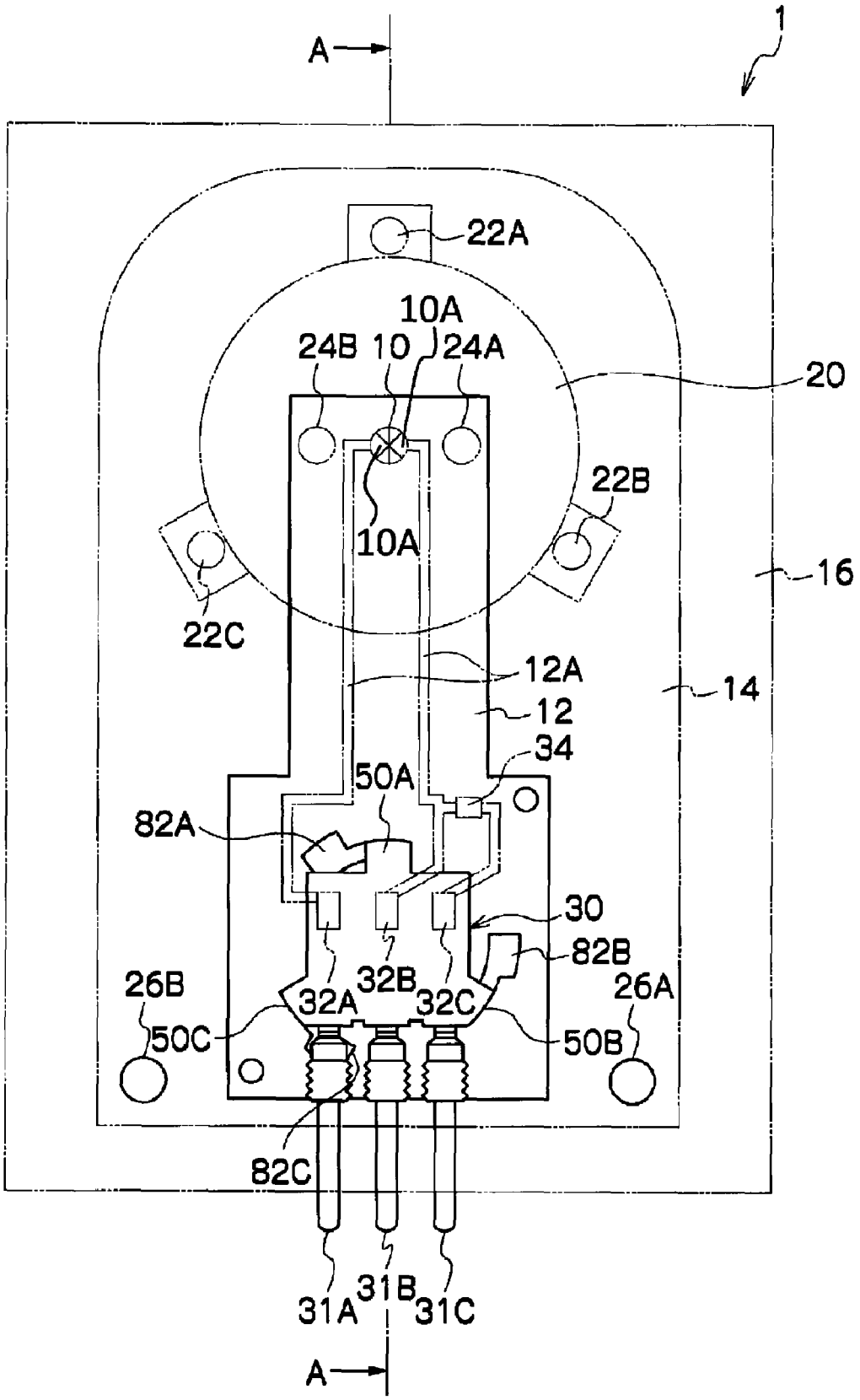
FIG. 1 is a front view showing an exemplary embodiment of an LED optical unit made in accordance with principles of the disclosed subject matter.
Figure 2:
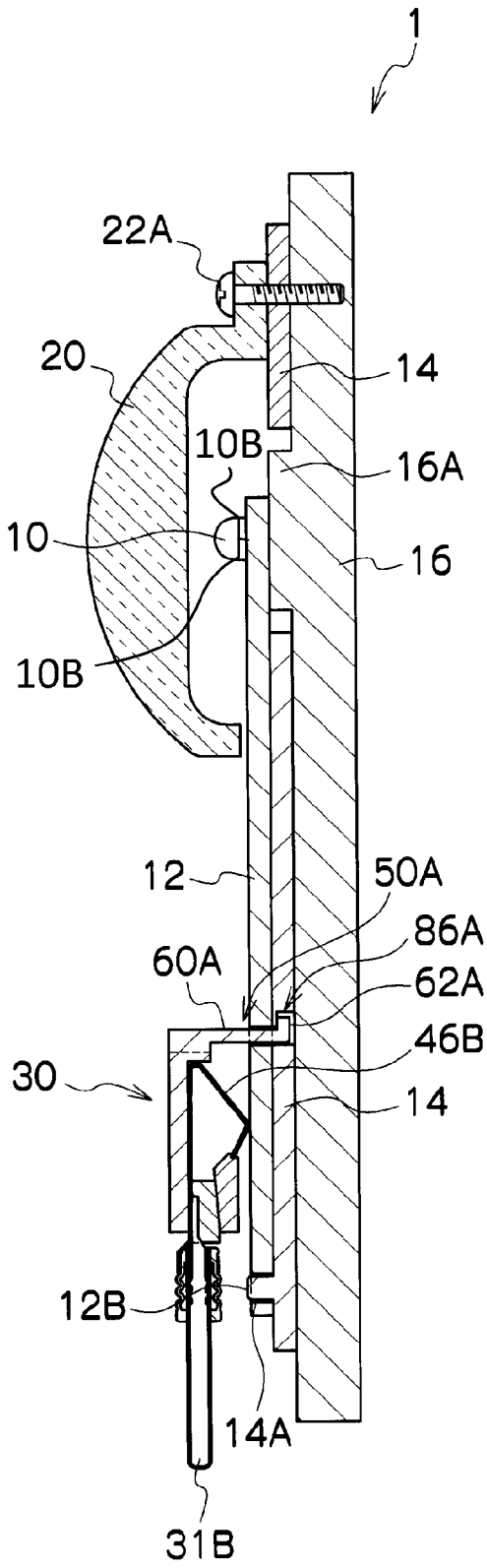
FIG. 2 is a cross-section side view of the exemplary LED optical unit taken along line A-A of FIG. 1.

The disclosed subject matter will now be described in detail with reference to FIGS. 1 to 11, in which the same or corresponding elements use the same reference marks. FIG. 1 is a front view showing an exemplary embodiment of an LED optical unit made in accordance with principles of the disclosed subject matter. FIG. 2 is a cross-section side view of the exemplary LED optical unit taken along line A-A of FIG. 1.

The LED optical unit 1 can include: a printed circuit board 12 on which an LED 10 is mounted; a heat shield plate 14 located adjacent to the printed circuit board 12 to shield heat generated from the LED 10; a heat sink 16 located adjacent to the printed circuit board 12 and the heat shield plate 14 and configured to radiate and/or conduct the heat generated from the LED 10; and an optical lens 20 located adjacent to the heat shield plate 14 and configured to illuminate light emitted from the LED 10 with a prescribed light distribution pattern. The circuit board 12 can include a pair of mounting pads 10A upon which electrodes 10B of the LED 10 can be mounted. The mounting pads 10A can be electrically connected to the conductor patterns 12A, and thus can be electrically connected to the conductor pads 32A-32C. The shape of the mounting pads 10A can vary greatly depending on the shape and type of the LED 10, and depending on the type of attachment between the LED 10 and the mounting pads 10A. The electrodes 10B of the LED 10 can also be shaped in various manners, including bottom or side mount type electrodes, pin type electrodes, etc.

The optical lens 20 can be attached to the heat sink 16 through the heat shield plate 14 by screws 22A, 22B and 22C so that the heat shield plate 14 is sandwiched between the optical lens 20 and the heat sink 16. The printed circuit board 12 can also be attached to the heat sink 16 through the heat shield plate 14 by screws 24A and 24B so that the heat shield plate 14 is sandwiched between the printed circuit board 12 and the heat sink 16. The heat shield plate 14 can be attached to the heat sink 16 by the screws 22A-22C, 24 and screws 26A, 26B.

Therefore, the printed circuit board 12, the heat shield plate 14, the heat sink 16 and the optical lens 20 can be attached at a predetermined position with respect to each other. In this case, a downward side of the printed circuit board 12 can be positioned by inserting a positional pin 14A of the heat shield plate 14 into a hole 12B of the printed circuit board 12 as shown in FIG. 2. In addition, a connector 30 can be attached to the printed circuit board 12 and the heat shield plate 14, as described later in detail.

The heat sink 16 can include a projecting portion 16A configured to efficiently radiate or conduct the heat generated from the LED 10. The projecting portion 16A can be in contact with an opposite surface of an LED mounting portion of the printed circuit board 12. Accordingly, the heat shield plate 14 can include a cutout section so that the projecting portion 16A of the heat sink 16 can directly contact with the opposite surface of a mounting surface of the printed circuit board 12.

The heat shield plate 14 can be provided to prevent transmitting heat of the heat sink 16 to the optical lens 20. Therefore, the heat shield plate 14 can be located between the optical lens 20 and the heat sink 16. However, in exemplary embodiments of the disclosed subject matter, the heat shield plate 14 can be extended toward a downward end of the printed circuit board 12 that includes the connector 30. The heat shield plate 14 can also be used as an attachment member for attaching the connector 30. The attachment structure of the connector 30 will be described later in detail.

On the printed circuit board 12, conductor patterns 12A for providing the LED 10 with a power supply via the connector 30 can be formed. In addition, conductor pads 32A, 32B and 32C that can be connected to the connector 30 can be formed. The LED 10 and circuit components (e.g. a resistor 34) can be mounted at predetermined positions on the printed circuit board 12 in a reflow process and the like, and the connector 30 can be attached to the printed circuit board 12 and the heat shield plate 14 by the attachment structure as described later without a fixing member such as a screw, etc.

The connector 30 can include three cables 31A, 31B and 31C, and the cables 31A, 31B and 31C can be connected to the conductor pad 32A, 32B and 32C via terminal members 46A, 46B and 46C, respectively (the cable 31B and the terminal member 46B are shown in FIG. 2). In the cables 31A, 31B and 31C, for example, the cables 31A and 31C can be used for receiving or providing a power supply, and the cable 31B can be used for an LED current detector, in which voltage changes in accordance with a current that flows in the LED 10.

The connector 30 can include attachment portions 50A, 50B and 50C as show in FIG. 1, and each of the attachment portions 50A, 50B and 50C can include leg portions 60A, 60B and 60C that include engaging portions 62A, 62B and 62C located at edge portions thereof, respectively (the leg portion 60A and the engaging portion 62A of the attachment portion 50A are shown in FIG. 2).

When each of the attachment portions 50A, 50B and 50C is inserted into first insert slits 82A, 82B and 82 C that are formed in the printed circuit board 12 and the heat shield plate 14 as shown in FIG. 1 and is rotated clockwise, the connector 30 can be attached to the printed circuit board 12 and the heat shield plate 14, while each of the engaging portions 62A, 62B and 62C can be engaged with lock grooves 86A, 86B and 86C that are formed in the heat shield plate 14 and can be pulled toward the printed circuit board 12 in the lock grooves 86A, 86B and 86C by elastic forces applied by each of the terminal members 46A, 46B and 46C.

Figure 3:
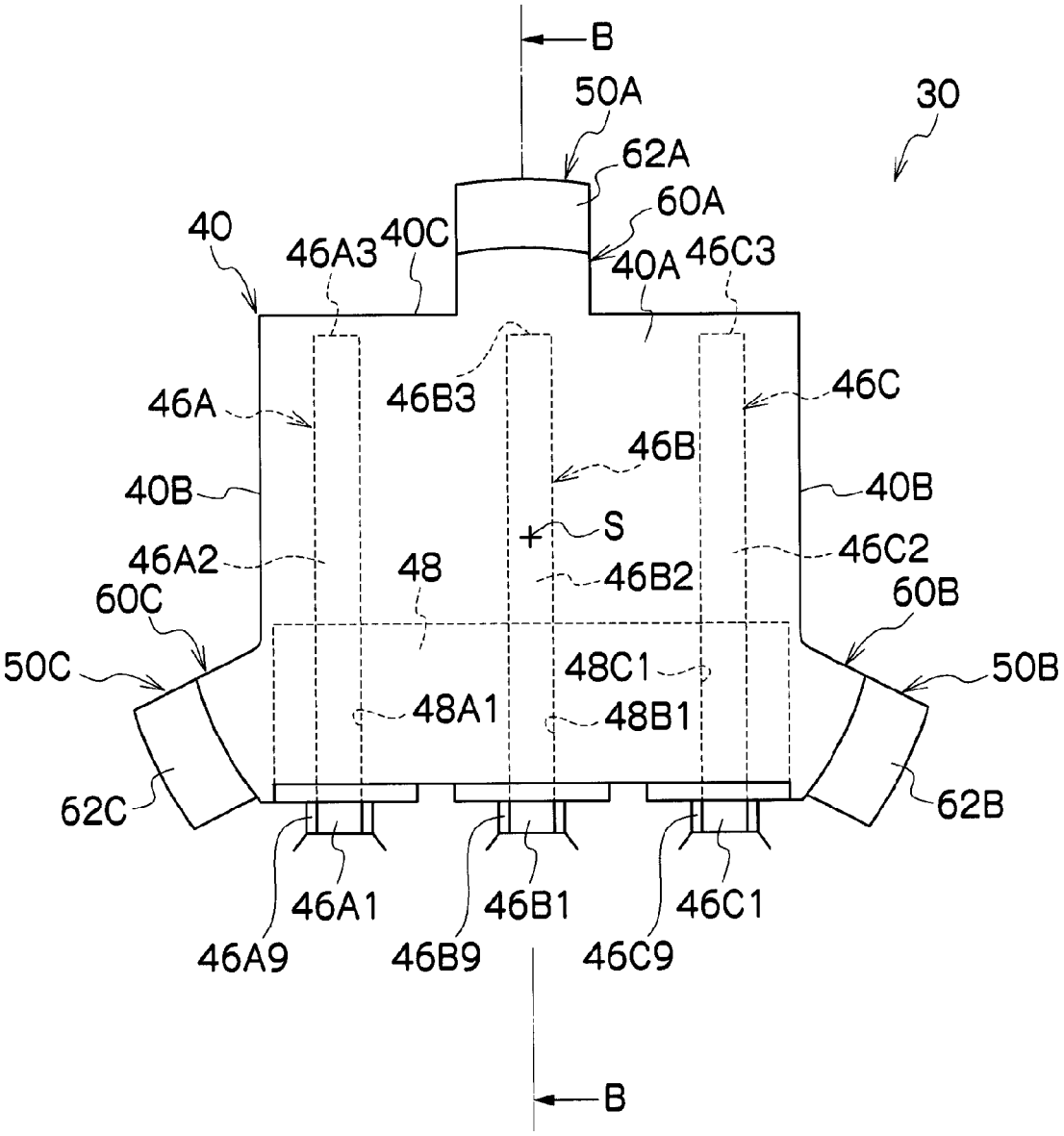
FIG. 3 is a front view of an exemplary connector for receiving a power supply.
Figure 4:
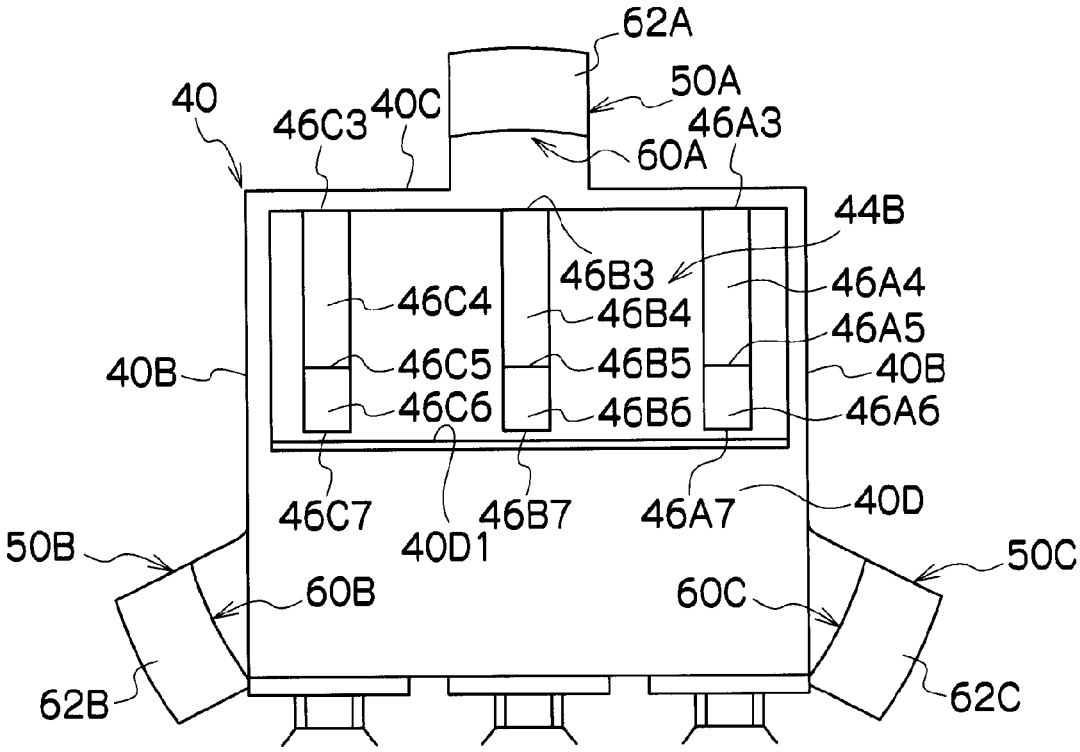
FIG. 4 is a rear view of the exemplary connector of FIG. 3.
Figure 5:
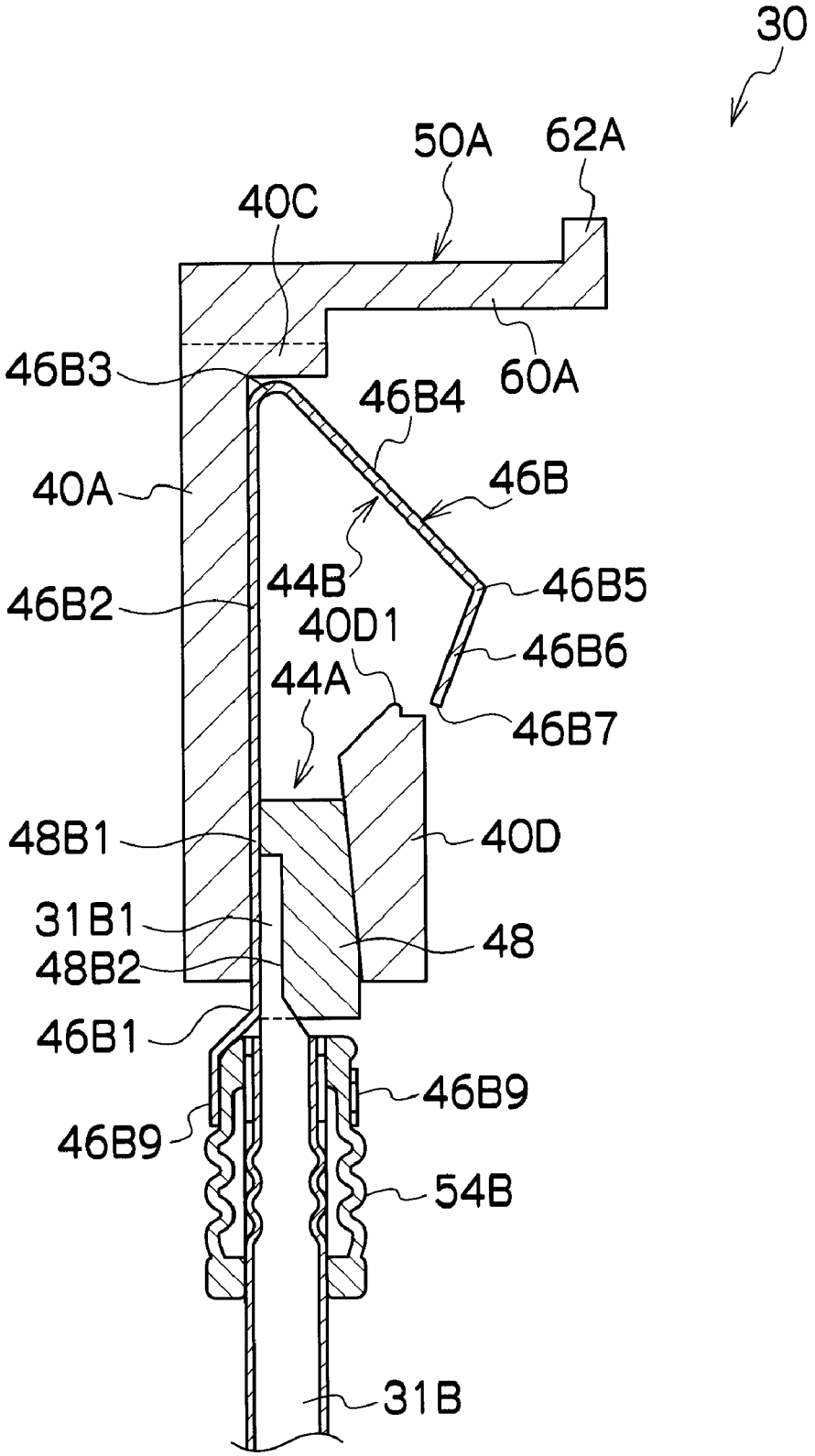
FIG. 5 is a cross-section side view of the exemplary connector taken along line B-B of FIG. 3.

A structure of the connector 30 will now be described in detail. FIGS. 3 and 4 are a front view and a rear view showing a structure of the connector 30, and FIG. 5 is a cross-section side view showing the structure of the connector 30 taken along line B-B of FIG. 3. The connector 30 can include a body 40 that is made of a resin, and the body 40 can include a front plate 40A, side plates 40B, a top plate 40C, and a rear plate 40D.

In addition, the connector 30 can include: an insert opening 44A that is formed at a rearward side of the body 40; the terminal members 46A, 46B and 46C having an elastic force that are formed in a plate shape and can be inserted into the insert opening 44A from an inside of body 40; a fixing member 48 to fix the terminal members 46A, 46B and 46C at a prescribed position; and the attachment portions 50A, 50B and 50C that can respectively be integrated into the top plate 40A and the side plates 40B of the body 40 and can extend outwards to be attached to the printed circuit board 12 and the heat shield plate 14.

The fixing member 48 can include guide slits 48A1, 48B1 and 48C1 that are located in a substantially parallel direction with the side plates 40B and are located at a predetermined interval in a parallel direction with the top plate 40A. The fixing member 48 can be inserted into the insert opening 44A while the terminal members 46A, 46B and 46C are engaged with each of the guide slits 48A1, 48B1 and 48C1 of the fixing member 48. Therefore, the terminal members 46A, 46B and 46C can be located at a predetermined position of the body 40 so as to be sandwiched between the top plate 40A and the fixing member 48.

Each of the terminal members 46A, 46B and 46C can be structured in the same shape including the same components. Consequently, the terminal member 46B is described with reference to FIG. 5, and descriptions of the terminal members 46A and 46C will be accordingly abbreviated. In the downward side of the body 40, an edge portion 46B1 of the terminal member 46B can be exposed from the top plate 40A of the body 40. A cable connecting portion 46B9 can be integrated into the terminal member 46B, and the cable connecting portion 46B9 can be formed in a tubular shape.

The cable connecting portion 46B9 can be wrapped around an external member 54B that is provided at an end portion of the cable 31B as shown in FIG. 5, and thereby the terminal member 46B can be connected to the cable 31B. That is, when the cable is inserted into the edge portion 46B1 of the terminal member 46B via the cable connecting portion 46B9, a wire 31B1 of the cable 31B can be exposed from the cable 31B, and can be inserted into a connecting slit 48B2, which is located between the guide slit 48B1 of the fixing member 48 and the edge portion 46B1 of the terminal member 46B.

Therefore, the wire 31B1 of the cable 31B can be electrically connected to the terminal member 46B. In this case, a crimp type terminal can be attached to the wire 31B1 of the cable 31B, and the crimp type terminal of the wire 31B1 can also be attached to the cable connecting portion 46B9. Moreover, the wire 31B1 can be electrically connected to the connecting slit 48B2 after the wire 31B1 is exposed from the cable 31B, and the cable 31B can also be attached to the cable connecting portion 46B9 with a press bonding.

The terminal member 46B can include: a base portion 46B2 linearly extending from the edge portion 46B1 toward the top plate 40C of the body 40 along the front plate 40A; a bending portion 46B3 bending toward the edge portion 46B1 from the base portion 46B2; a first linear portion 46B4 linearly extending from the bending portion 46B3 toward the edge portion 46B1; a contact portion 46B5 bending from the first linear portion 46B4 toward the base portion 46B2; and a second linear portion 46B6 linearly extending from the contact portion 46B5 toward an end portion 46B7.

In addition, the contact portion 46B5 of the terminal member 46B can project from an opening 44B that is formed toward the rear plate 40D of the body 40 to an extent that is further from the front plate 40A than the rear plate 40D is from the front plate 40A. When the connector 30 is attached to the printed circuit board 12 and the heat shield plate 14, the contact portion 46B5 of the terminal member 46B can contact with the conductor pad 32B of the printed circuit board 12, and therefore the terminal member 46B can be electrically connected to the conductor pad 32B as described later.

The rear plate 40D can include a supporting hook 40D1 that projects toward the opening 44B as shown in FIG. 5. When the contact portion 46B5 of the terminal member 46B contacts with the conductor pad 32B of the printed circuit board 12, the first linear portion 46B4, the contact portion 46B5, the second linear portion 46B6 and the end portion 46B7 can move toward the rear plate 40D of the body 40, and the end portion 46B7 can be engaged with the supporting hook 40D1 of the rear plate 40D. Accordingly, the end portion 46B7 can stop moving toward the rear plate 40D due to contact with the supporting hook 40D1.

When the connector 30 is removed from the printed circuit board 12, the first linear portion 46B4, the contact portion 46B5, the second linear portion 46B6 and the end portion 46B7 can move toward the printed circuit board 12 and can be returned in a state shown in FIG. 5. Therefore, the end portion 46B7 can be spaced from the supporting hook 40D1 of the rear plate 40D of the body 40.

The connector 30 can include a central axis S that intersects with the base portion 46B2 of the terminal member 46B at a substantially right angle as shown in FIG. 3. Each of the attachment portions 50A, 50B and 50C can be formed in the same shape with respect to the central axis S. That is, when the connector 30 is rotated 120 degrees clockwise around the central axis S, the attachment portion 50A can be positioned at the attachment portion 50B, and the attachment portion 50B can be positioned at the attachment portion 50C.

Each of the attachment portions 50A, 50B and 50C can include: leg portions 60A, 60B and 60C that extend toward the contact portion 46B5 of the terminal member 46B; and the engaging portions 62A, 62B and 62C that project in a direction substantially perpendicular to the leg portions 60A, 60B and 60C, respectively. The attachment portion 50A, the leg portion 60A and the engaging portion 62A are shown in FIG. 5. These will be described later in detail.

Figure 6:
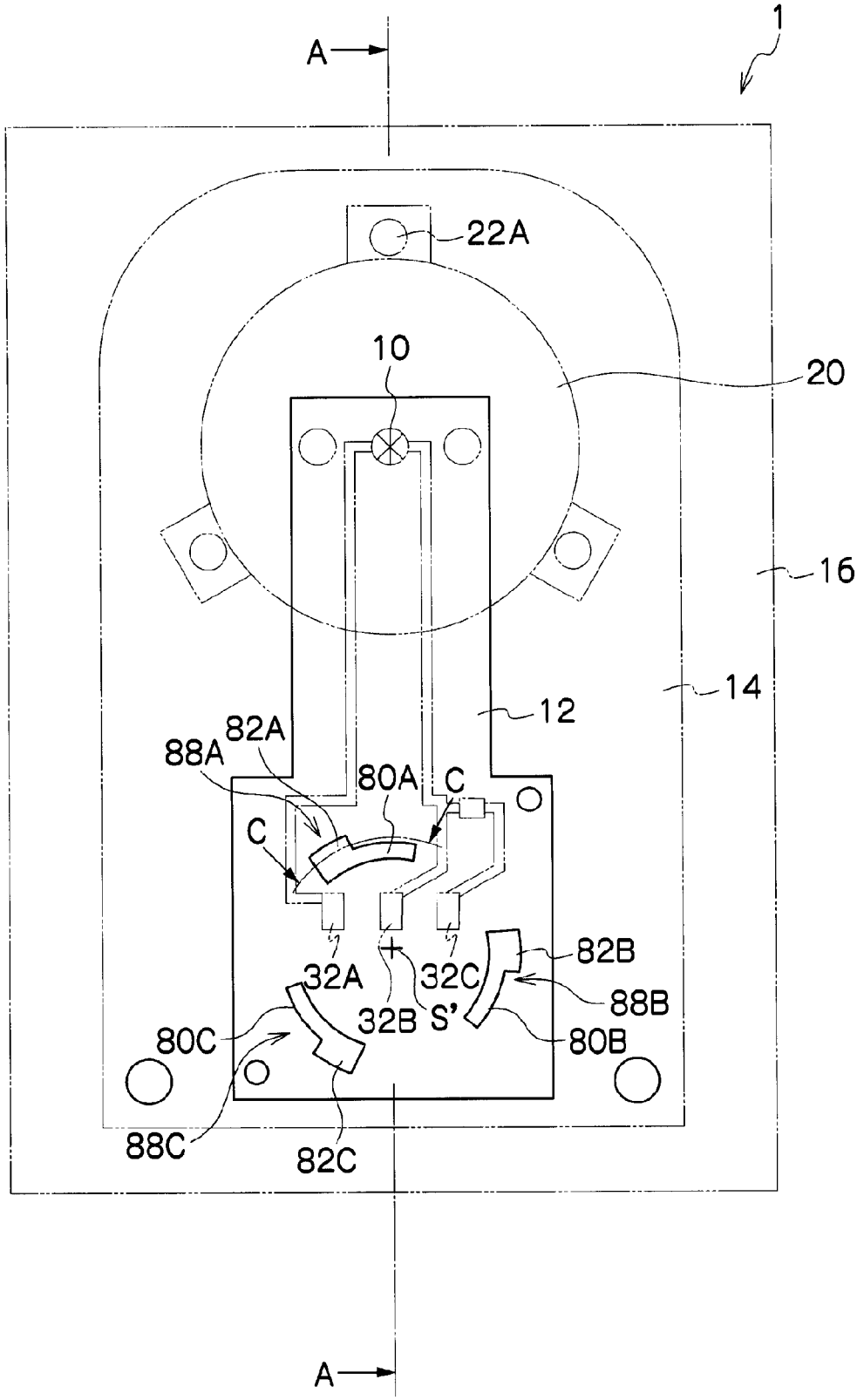
FIG. 6 is a front view depicting an exemplary LED optical unit in which the exemplary connector is removed.
Figure 7:
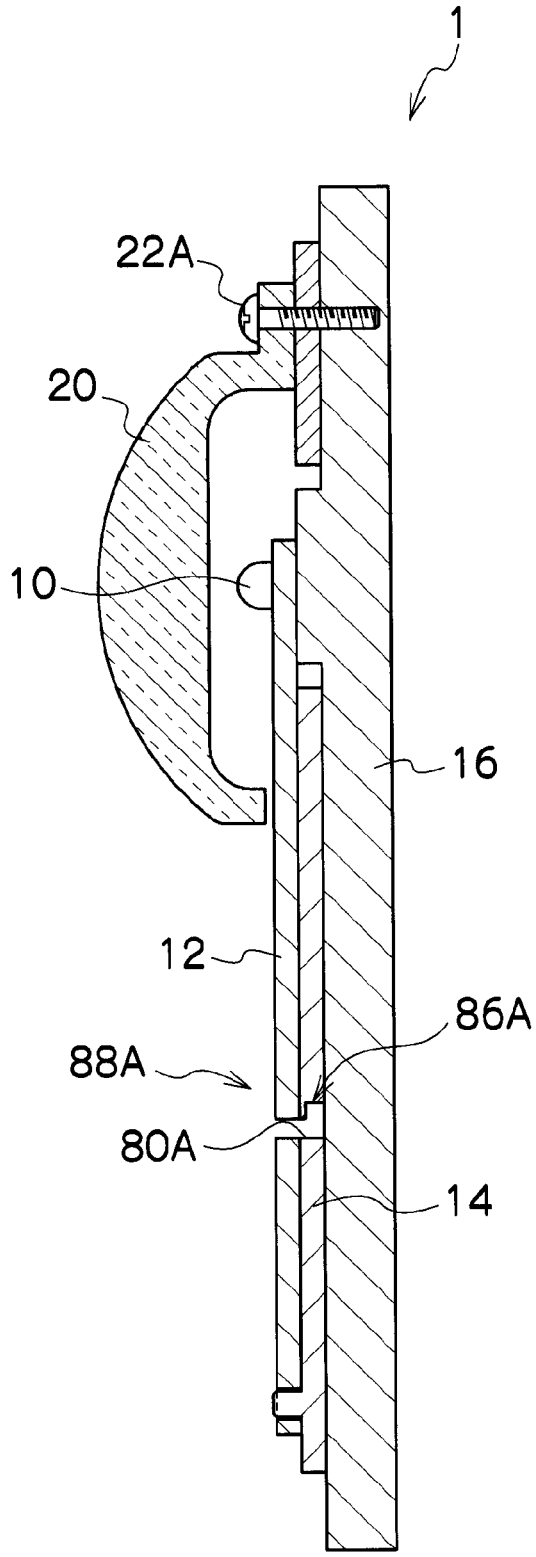
FIG. 7 is a cross-section side view of the exemplary LED optical unit taken along line A-A of FIG. 6.

A structure of the printed circuit board 12 will now be given. FIG. 6 is a front view depicting the structure of the LED optical unit 1 in which the connector 30 is removed. FIG. 7 is a cross-section side view depicting the LED optical unit 1 taken along line A-A shown in FIG. 6. The printed circuit board 12 can include an axis S' corresponding to the central axis S of the connector 30.

The printed circuit board 12 can include arc grooves 88A, 88B and 88C, which are formed in the same shape with respect to the axis S'. Therefore, when the arc grooves 88A, 88B and 88C are rotated 120 degrees clockwise around the axis S', the arc groove 88A can be positioned at the original arc groove 88B, and the arc groove 88B can be positioned at the original arc groove 88C. Thus, when the central axis S of the connector 30 corresponds to the axis S' of the printed circuit board 12, the attachment portions 50A, 50B and 50C of the connector 30 can correspond to the arc grooves 88A, 88B and 88C of the printed circuit board 12.

Each of the arc grooves 88A, 88B and 88C can include the same structure including the same components. Consequently, the arc groove 88A will be described with reference to FIGS. 6 and 7, and descriptions of the arc grooves 88B and 88C will be accordingly abbreviated. The arc groove 88A can include a first insert slit 82A and a second insert slit 80A that is thinner than the first insert slit 82A as shown in FIG. 6

Each of the first insert slit 82A and the second insert slit 80A can be located on arcs that are formed with a center on the axis S', and can be formed in the printed circuit board 12 and the heat shield plate 14 so as to penetrate both the printed circuit board 12 and the heat shield plate 14 as shown in FIG.

7. The first insert slit 82A can be formed in a shape such that the engaging hook 62A of the leg portion 60A of the connector 30 can be inserted into the first insert slit 82A. When the connector 30 is attached to the printed circuit board 12 and the heat shield plate 14, the engaging portion 62A is initially inserted into the first insert slit 82A.

The second insert slit 80A can be formed in a shape such that the leg portion 60A of the connector 30 can slide into the second insert slit 80A and can be prevented from falling out of the second insert slit 80A. After the engaging portion 62A of the connector 30 is inserted into the first insert slit 82A, when the connector 30 is rotated clockwise, the leg portion 60A can move along the second insert slit 80A. In this case, the connector 30 can be rotated around the central axis S corresponding to the axis S' of the printed circuit board 12.

Figure 8:
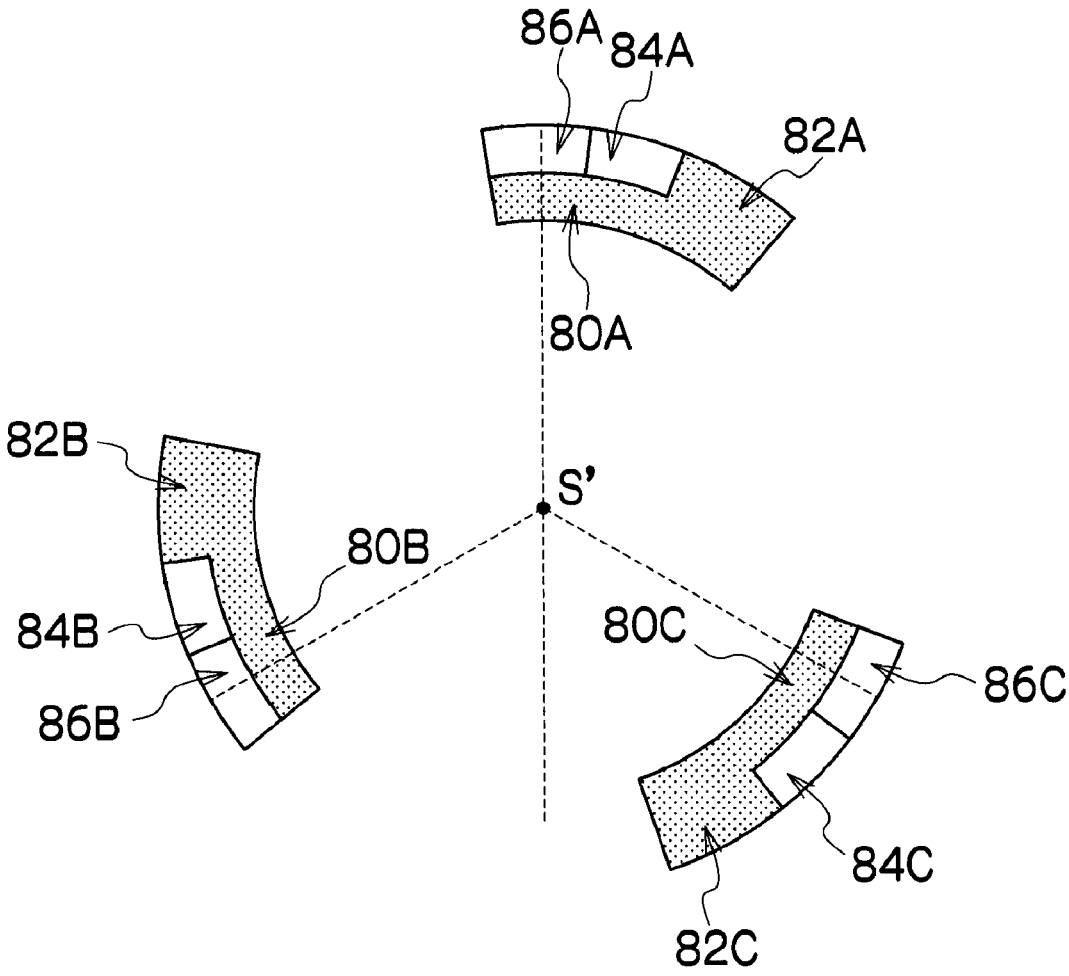
FIG. 8 is a drawing of arc grooves shown from a rear side of a heat shield plate.
Figure 9:
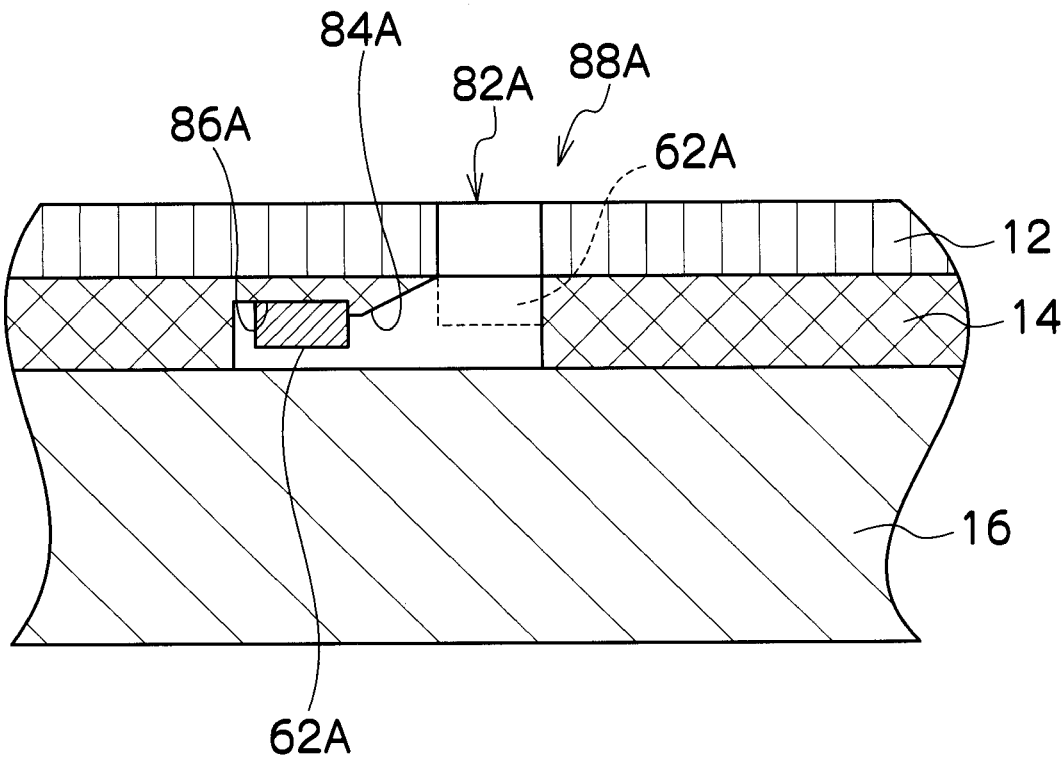
FIG. 9 is a cross-section view taken along line C-C of FIG. 6 showing the arc grooves.

FIG. 8 is a drawing of the arc grooves 88A, 88B and 88C shown from a rear side of the heat shield plate 14, and FIG. 9 is a cross-section view showing the arc grooves 88A, 88B and 88C taken along the line C-C shown in FIG. 6. Each of the arc grooves 88A, 88B and 88C can include guide surfaces 84A, 84B and 84C and lock grooves 86A, 86B and 86C in an extending region of the first insert slits 82A, 82B and 82C and in outward directions of the second insert slits 80A, 80B and 80C, respectively. The guide surfaces 84A, 84B and 84C and the lock grooves 86A, 86B and 86C can be formed in the heat shield plate 14 rather than in the printed circuit board 12.

The guide surface 84A can be a sliding surface, on which the engaging portion 62A shown by a solid and broken lines in FIG. 9 can be slid from the first insert slit 82A to the lock groove 86A. After the leg portion 60A of the connector 30 is inserted into the first insert slit 82A, when the connector 30 is rotated clockwise, the engaging portion 62A of the connector 30 can move on the guide surface 84A while the leg portion slides into the second insert slit 80A.

In addition, when the leg portion 60A of the connector 30 is inserted into the first insert slit 82A, the contact portion 46B5 of the terminal member 46B of the connector 30 can contact with the printed circuit board 12, and therefore the terminal member 46B can deform due to the elasticity thereof. The connector 30 can be biased in a direction away from the printed circuit board 12 because of the elastic force of the terminal member 46B.

Consequently, when the engaging portion 62A of the connector 30 moves on the guide surface 84A by rotating the connector 30, the engaging portion 62A can move on the guide surface 84A unless the connector 30 is pushed toward the printed circuit board 12 by using a predetermined force. The guide surface 84A can be slanted from the first insert slit 82A toward the lock groove 86A as shown in FIG. 9. Therefore, when the connector 30 is rotated clockwise, because the connector 30 gradually approaches the printed circuit board 12, a pushing stress of the contact portion 46B5 of the terminal member 46B can gradually increase.

The lock groove 86A can be formed in the heat shield plate 14 and can be located closer to the printed circuit board 12 than a boundary between the guide surface 84A and the lock groove 86A. When the connector 30 is rotated clockwise and the engaging portion 62A of the connector 30 gets to the lock groove 86A, the engaging portion 62A can be inserted with the lock groove 86A while the engaging portion 62A is pulled toward the printed circuit board 12 by the terminal member 46B of the connector 30 due to the elastic force of the terminal member 46B. Therefore, the connector 30 can stop being rotated, and can be locked unless it is pushed using a predetermined force.

Figure 10:
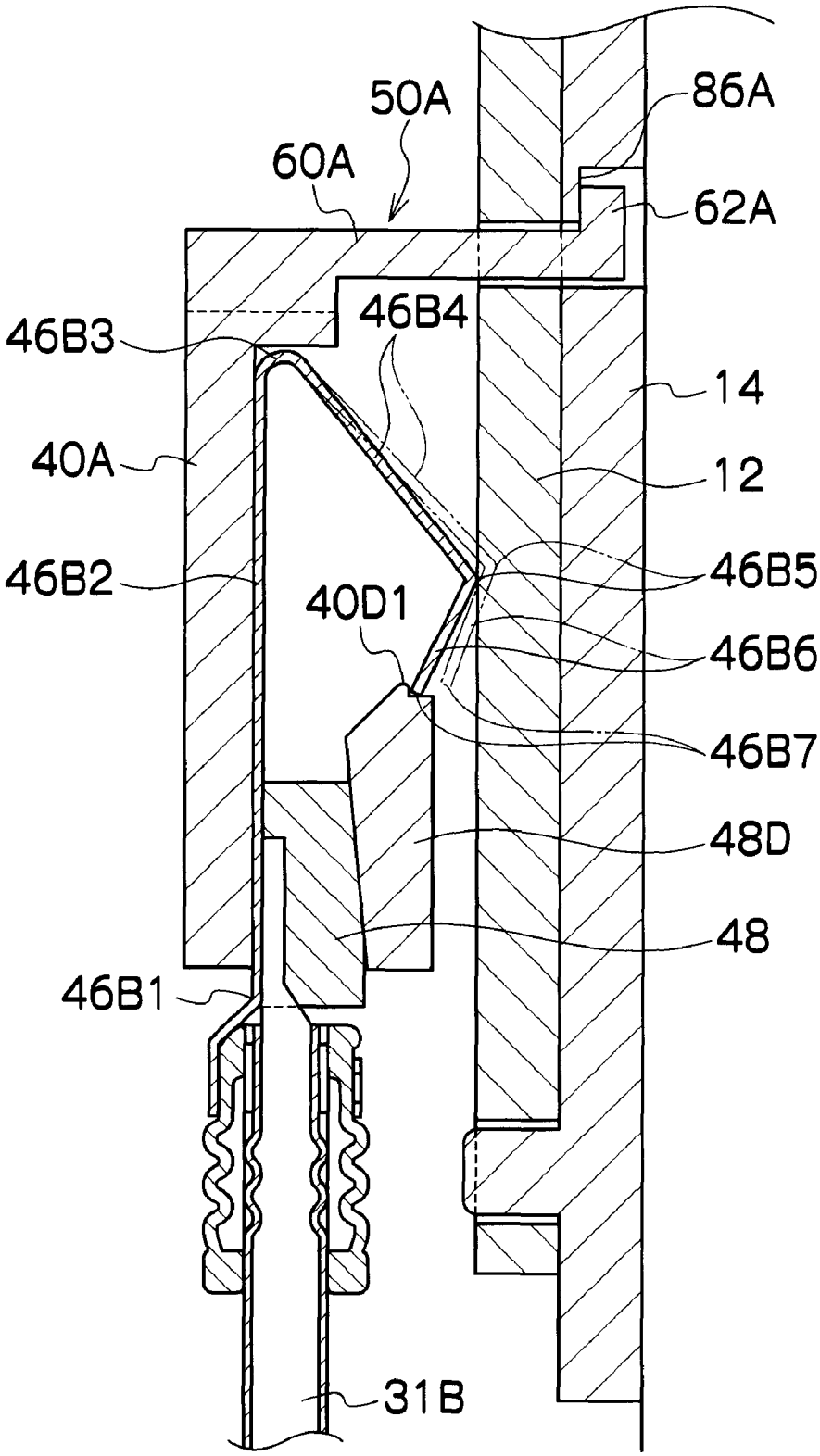
FIG. 10 is a close up cross-section side view of a peripheral region including the exemplary connector in a state that the connector is locked by a printed circuit board and the heat shield plate.

FIG. 10 is a close up cross-section side view of a peripheral region including the connector 30 in a state that the connector 30 is locked by the printed circuit board 12 and the heat shield plate 14. When the engaging portion 62A of the attachment portion 60A of the connector 30 is engaged with the lock groove 86A of the heat shield plate 14, the end portion 46B7 of the terminal member 46B can be engaged with the supporting hook 40D1 of the rear plate 40D, and therefore the terminal member 46B can deform due to the elasticity thereof (the terminal member shown by two-dot chain lines in FIG. 10 is in a state of nonelastic deformation).

In this case, because the contact portion 46B5 of the terminal member 46B can exhibit a large elastic force, the contact portion 46B5 can contact with the conductor pad 32B of the printed circuit board 12 with the large elastic force. Thus, terminal member 46B of the connector 30 can be electrically connected to the conductor pad 32B of the printed circuit board 12 with confidence. A method for attaching the connector 30 to the printed circuit board 12 will now be given.

Figure 11A:
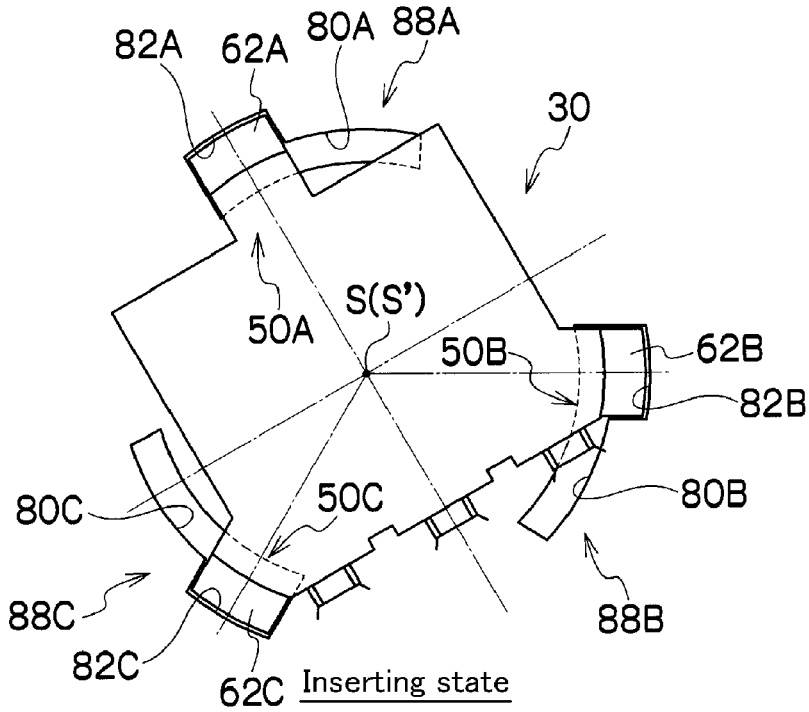
FIGS. 11*a* and 11*b* are explanatory front views showing an inserting state and a locking state of the connector, respectively.
Figure 11B:
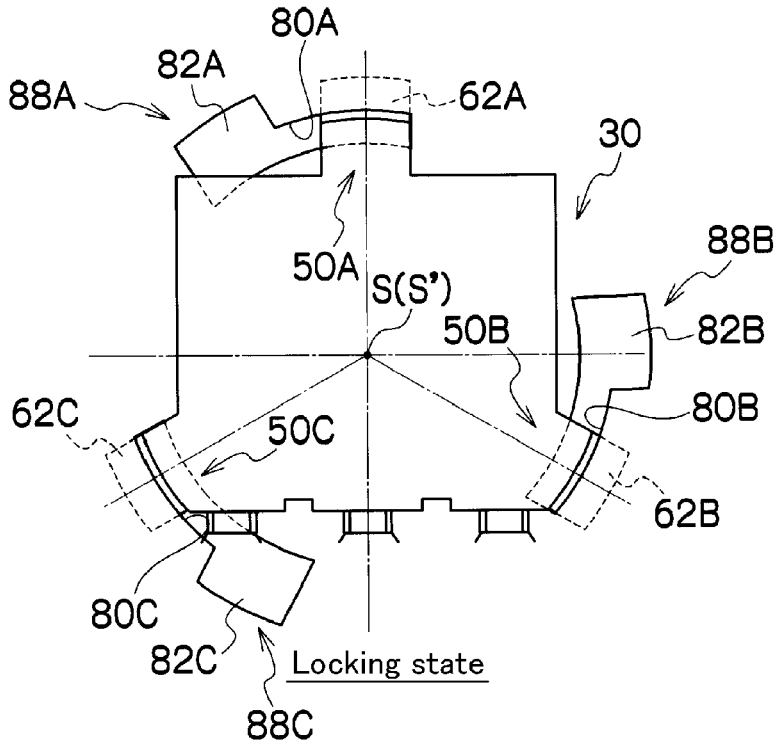
Figure 12A:
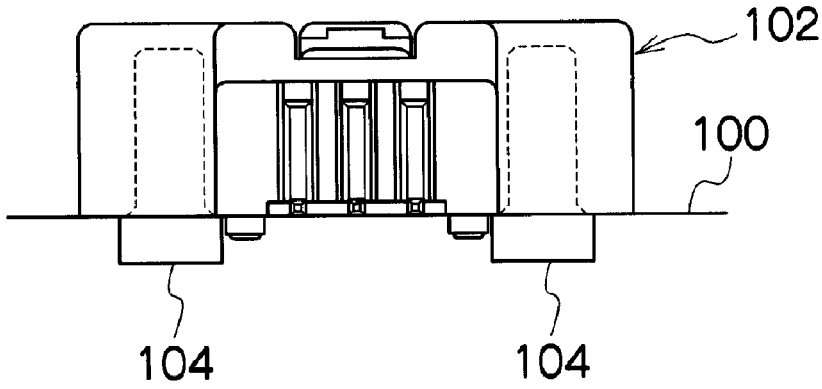
FIG. 12a Conventional Art
FIG. 12*a* is a front view showing a conventional attachment structure of a connector mounted on a printed circuit board.
Figure 12B:
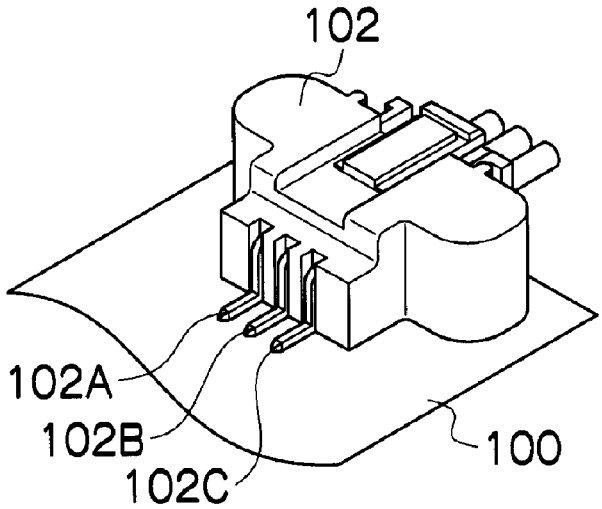
FIG. 12b Conventional Art
FIGS. 12*b* and 12*c* are perspective views showing a connecting state of the connector and a coupler and a disconnecting state thereof, respectively.
Figure 12C:
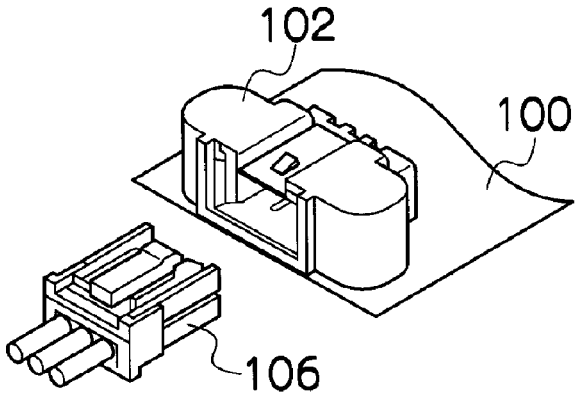
FIG. 12c Conventional Art
Figure 13:
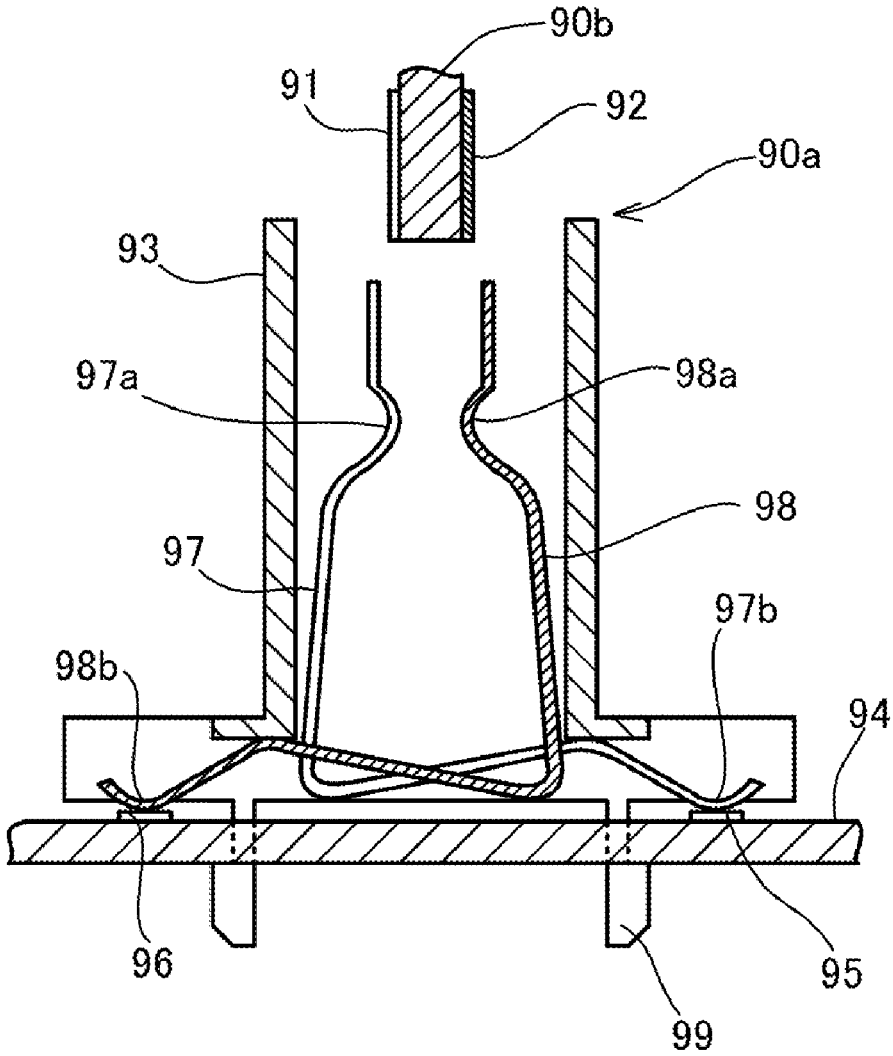
FIG. 13 Conventional Art
FIG. 13 is a cross-section view showing another conventional attachment structure of a connector mounted on a printed circuit board.

FIGS. 11*a* and 11*b* are explanatory front views showing an inserting state and a locking state of the connector 30, respectively. The engaging portions 62A, 62B and 62C of the attachment portions 50A, 50B and 50C of the connector 30 can be inserted into the first insert slits 82A, 82B and 82C of the arc grooves 88A, 88B and 88C, respectively. The engaging portions 62A, 62B and 62C can be inserted into the first insert slit 82A, 82B and 82C so that they can be rotated on the guide surfaces 84A, 84B and 84C, respectively.

In this case, the contact portions 46A5, 46B5 and 46C5 of the connector 30 can contact with the printed circuit board 12. After that, as the engaging portions 62A, 62B and 62C move on the guide surfaces 84A, 84B and 84C, respectively, the contact portions 46A5, 46B5 and 46C5 can move toward the front plate 40A of the connector 30. When the contact portions 46A5, 46B5 and 46C of the connector 30 are inserted into the lock grooves 86A, 86B and 86C, respectively, each of the edge portions 46A7, 46B7 and 47C7 of the terminal members 46A, 46B and 46C can be engaged with the supporting hook 40D1 of the rear plate 40D.

When the connector 30 is rotated clockwise until the attachment portions 50A, 50B and 50C of the connector 30 get to ends of the second insert slits 80A, 80B and 80C as shown in FIG. 11*b*, the engaging portions 62A, 62B and 62C of the attachment portions 50A, 50B and 50C can be engaged with the lock grooves 86A, 86B and 86C, respectively. FIG. 9 shows the relation between the engaging portion 62A and the lock groove 86A when the engaging portion 62 gets to the lock groove 86A via the guide surface 84A.

In this case, as each of the engaging portions 62A, 62B and 62C approaches the lock grooves 86A, 86B and 86C along the slants of the guide surfaces 84A, 84B and 84C, respectively, each of the engaging portions 62A, 62B and 62C can approach the heat sink 16. The elastic forces of the terminal members 46A, 46B and 46C can gradually increase. Each of the end portions 46A7, 46B7 and 46C7 of the terminal members 46A, 46B and 46C can contact with the supporting hook 40D1 of the rear plate 40D before each of the engaging portions 62A, 62B and 62C is engaged with the lock grooves 86A, 86B and 86C, respectively.

Therefore, as each of the engaging portions 62A, 62B and 62C approaches the lock grooves 86A, 86B and 86C, respectively, the above-described elastic forces of the terminal members 46A, 46B and 46C can gradually increase. Thus, when each of the engaging portions 62A, 62B and 62C is engaged with the lock grooves 86A, 86B and 86C, respectively, the contact portions 46A5, 46B5 and 46C5 can contact with the conductor pads 32A, 32B and 32C of the printed circuit board 12 with confidence by using the large elastic forces of the terminal members 46A, 46B and 46C.

When the connector 30 is removed from the printed circuit board 12 and the heat shield plate 14, each of the engaging portions 62A, 62B and 62C can be spaced from the lock grooves 86A, 86B and 86C by pushing the connector 30 toward the printed circuit board 12. After that, the connector 30 is rotated counterclockwise, and the connector 30 can be removed from the printed circuit board 12 and the heat shield plate 14 when each of the leg portions 60A, 60B and 60C is positioned at the first insert slits 82A, 82B and 82C, respectively.

As described above, the connector 30 can be attached to the printed circuit board 12 and the heat shield plate 14 by inserting each of the leg portions 60A, 60B and 60C into the first insert slits 82A, 82B and 82C and by rotating the connector 30. Consequently, a screwing process and a soldering process are not required to attach the connector 30 to the printed circuit board 12, and therefore the disclosed subject matter can result in a reduction of manufacturing processes.

In addition, when each of the cables 31A, 31B and 31C is connected to the cable connecting portions 46A9, 46B9 and 46C9, respectively, each of the wires 31A1, 31B1 and 31C1 can be exposed from the cables 31A, 31B and 31C and can be electrically connected to the terminal members 46A, 46B and 46C by inserting each of the cables 31A, 31B and 31C into the cable connecting portions 46A9, 46B9 and 46C9, respectively. Therefore, the disclosed subject matter can also result in a reduction of the number of parts.

Moreover, when the connector 30 is attached to the printed circuit board 12 and the heat shield plate 14, because each of the end portions 46A7, 46B7 and 46C7 of the connector 30 is engaged with the supporting hook 40D1 of the body 40, each of the terminal members 46A, 46B and 46C can operate as a plate spring in which both ends are supported. Therefore, because each of the contact portions 46A5, 46B5 and 46C5 of the connector 30 can contact with the conductor pads 32A, 32B and 32C of the printed circuit board 12 with confidence using the large elastic forces of the terminal members 46A, 46B and 46C, respectively, a reliable connecting state between the contact portions 46A5, 46B5 and 46C5 and the conductor pads 32A, 32B and 32C can be maintained even under a large vibration and shock, respectively.

Furthermore, the connector 30 can be biased in a direction away from the printed circuit board 12 due to the large elastic forces by engaging each of the end portions 46A7, 46B7 and 46C7 with the supporting hook 40D1 of the rear plate 40D of the connector 30. Accordingly, each of the engaging portions 62A, 62B and 62C of the connector 30 can be engaged with the lock grooves 86A, 86B and 86C by large elastic forces, respectively. Because a spinning motion can be used to remove the connector 30 from the printed circuit board 12, the connector 30 cannot be easily removed from the printed circuit board 12 and the heat shield plate 14, even under large vibration conditions.

In the above-described connector 30, a connector 30 including three attachment portions 50A, 50B and 50C is described. However, the connector 30 is not limited to three attachment portions 50A, 50B and 50C. The connector 30 can include a plurality of attachment portions such as two portions, four portions, etc. In addition, a heat shield plate 14 including the lock grooves 86A, 86B and 86C is described. The lock grooves 86A, 86B and 86C can be included in the heat sink 16 by including the arc grooves 88A, 88B and 88C in the heat sink 16.

A method for using the above-described LED optical unit 1 for a vehicle lamp will now be described. When the LED optical unit 1 is used for a headlight, the LED 10 can be composed of a white LED light source. The white LED light source can be composed of a blue LED chip and a yellow phosphor such as YAG (yttrium aluminum garnet), etc. Additionally, the optical lens can be composed of a projector type lens to form a prescribed light distribution pattern using light emitted from the white LED light source. In this case, an optical axis of the projector lens can correspond to an optical axis of the white LED light source to form a favorable light distribution pattern.

The projector lens can include at least one cutout section in a vertical direction of the headlight to efficiently radiate heat generated from the white LED light source along with the heat sink 16, and the cutout section can face the printed circuit board. The projector lens can be attached to the heat shield plate 14 so as not to contact with printed circuit board 12 in order to avoid conduction of the heat generated from the white LED light source and the printed circuit board 12.

The above-described LED optical unit 1 can be attached to a housing, and an outer lens can be attached to the housing so as to cover the LED optical unit 1 therewith. The headlight can include a fulcrum shaft based on the housing such that it can be revolved when adjusting a light distribution pattern thereof, and a first screw configured to rotate the LED optical unit 1 in a first direction about a fulcrum point of the fulcrum shaft, and a second screw configured to rotate the LED optical unit 1 in a second direction about the fulcrum point, the first direction being substantially normal to the second direction.

The first screw can revolve portions of the LED optical unit 1 in a horizontal direction with respect to the optical axes of the white LED light source and the projector lens in order to make adjustments in a horizontal direction of the light distribution pattern, and the second screw can revolve portions of the LED optical unit 1 in a vertical direction with respect to the optical axes in order to make adjustments in a vertical direction of the light distribution pattern.

When the LED optical unit 1 is used for a tail lamp, the LED 10 can be composed of a plurality of red LEDs. The optical lens 20 can be composed of a diffusing lens to form a wide light distribution pattern using light emitted from the LEDs 1. In this case, because an amount of heat generated from the LED 10 may be smaller than that of the above-described headlight, the heat sink 16 may be removed from the LED optical unit 1. Moreover, the tail lamp can also include a housing and an outer lens.

The LED optical unit 1 can be easily attached to a small housing, and the cable can also be easily connected to the connector. Furthermore, even when the vehicle lamp using the LED optical unit 1 is formed in a small size for a small size car, the vehicle lamp can provide a favorable light distribution with a simple structure. Thus, the disclosed subject matter can result in an improvement of workability and an increase of a possible range of vehicle lamp design.

Various modifications of the above disclosed embodiments can be made without departing from the spirit and scope of the presently disclosed subject matter. For example, the connector 30 can be attached to the printed circuit board 12 and the heat shield plate 14 using the above-described structure so as to slide the attachment portions into the insert slits in a lengthwise and/or crosswise direction. In addition, two connectors can be attached to the printed circuit board 12 and the heat shield plate 14 using the above-described structure by sliding attachment portions of the connectors into the insert slits from both directions and by integrating the two connectors into a whole connector.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. An LED optical unit, comprising:

a printed circuit board having an LED mounting surface and a plurality of insert slits, the LED mounting surface including at least one pair of mounting pads and a plurality of conductor pads, each of the at least one pair of mounting pads being electrically connected to one of the plurality of conductor pads, the plurality of insert slits penetrating into the printed circuit board, and the plurality of insert slits being located around the plurality of conductor pads so as to surround the conductor pads;

at least one LED having electrodes mounted on the at least one pair of mounting pads and each of the electrodes of the at least one LED being electrically connected to a respective one of each of the at least one pair of mounting pads;

a shield plate having a plurality of insert slits and an opposite surface, the plurality of insert slits of the shield plate formed in substantially the same shape as the plurality of insert slits of the printed circuit board and penetrating into the shield plate, the shield plate located adjacent to the printed circuit board so that the plurality of insert slits of the shield plate overlaps with the plurality of insert slits of the printed circuit board, the opposite surface of the shield plate located on an opposite side of a surface of the shield plate adjacent to the printed circuit board, and the opposite surface of the shield plate including a plurality of lock grooves located adjacent to the plurality of insert slits of the shield plate, and the plurality of lock grooves located closer to the printed circuit board than the opposite surface of the shield plate; and a connector having a body and a plurality of terminal members, the body including a front plate, a rear plate and a plurality of attachment portions, the plurality of attachment portions extending from the front plate toward the rear plate, each of the attachment portions including an engaging portion configured to engage with a respective one of the lock grooves of the shield plate, the plurality of terminal members located between the front plate and the rear plate, each of the terminal members including a cable connecting portion and a contact portion located so as to exhibit an elastic force when moved with respect to the front plate, the cable connecting portion projecting from the body and from a location between the front plate and the rear plate, each contact portion of the terminal members contacting with one of the conductor pads of the printed circuit board, and wherein the connector is configured to be attached to the printed circuit board and the shield plate by the engaging portion of each of the attachment portions and by using the elastic force exhibited by the contact portion of each of the plurality of terminal members.

2. The LED optical unit according to claim 1, further comprising:

a heat sink located adjacent to the shield plate, wherein the heat sink contacts with at least an opposite surface of the at least one pair of mounting pads of the LED mounting surface, and the shield plate is composed of a heat shield material.

3. The LED optical unit according to claim 1, further comprising:

an optical lens located adjacent to the shield plate so as to cover the at least one LED.

4. The LED optical unit according to claim 2, further comprising:

an optical lens located adjacent to the plate so as to cover the at least one LED.

5. The LED optical unit according to claim 1, wherein each cable connecting portion of the connector is directly connected to a cable.

6. The LED optical unit according to claim 2, wherein each cable connecting portion of the connector is directly connected to a cable.

7. The LED optical unit according to claim 1, further comprising:

guide surfaces located between each of the insert slits of the shield plate and each of the lock grooves of the shield plate, wherein each of the guide surfaces is slanted toward a respective one of each of the lock grooves.

8. The LED optical unit according to claim 2, further comprising:

guide surfaces located between each of the insert slits of the shield plate and each of the lock grooves of the shield plate, wherein each of the guide surfaces is slanted toward a respective one of each of the lock grooves.

9. An LED optical unit, comprising:

a printed circuit board having an LED mounting surface and a plurality of insert slits, the LED mounting surface including a pair of mounting pads and a plurality of conductor pads, each of the pair of mounting pads being electrically connected to one of the plurality of conductor pads, the plurality of insert slits penetrating into the printed circuit board, and the plurality of insert slits being located around the plurality of conductor pads so as to surround the conductor pads;

a white LED light source having an optical axis and electrodes and mounted on the pair of mounting pads, and each of the electrodes of the white LED light source being electrically connected to a respective one of each of the pair of mounting pads;

a heat shield plate having a plurality of insert slits and an opposite surface, the plurality of insert slits of the heat shield plate formed in substantially the same shape as the plurality of insert slits of the printed circuit board and penetrating into the heat shield plate, the heat shield plate located adjacent to the printed circuit board so that the plurality of insert slits of the heat shield plate overlaps with the plurality of insert slits of the printed circuit board, the opposite surface of the heat shield plate located on an opposite side of a surface of the heat shield plate adjacent to the printed circuit board, and the opposite surface of the heat shield plate including a plurality of lock grooves located adjacent to the plurality of insert slits of the heat shield plate, and the plurality of lock grooves located closer to the printed circuit board than the opposite surface of the heat shield plate;

a heat sink located adjacent to the opposite surface of the heat shield plate while contacting at least an opposite surface of the pair of mounting pads of the LED mounting surface;

a projector lens having an optical axis located adjacent to the heat shield plate so that the optical axis of the projector lens substantially corresponds to the optical axis of the LED light source and the projector lens does not contact with the printed circuit board; and a connector having a body and a plurality of terminal members, the body including a front plate, a rear plate and a plurality of attachment portions, the plurality of attachment portions extending from the front plate toward the rear plate, each of the attachment portions including an engaging portion configured to engage with one of the lock grooves of the heat shield plate, the plurality of terminal members located between the front plate and the rear plate, each of the terminal members including a cable connecting portion and a contact portion located so as to exhibit an elastic force when moved with respect to the front plate, the cable connecting portion projecting from the body and from a location between the front plate and the rear plate, each contact portion of the terminal members contacting with one of the conductor pads of the printed circuit board, and wherein the connector is configured to be attached to the printed circuit board and the heat shield plate by the engaging portion of each of the attachment portions and by using the elastic force exhibited by the contact portion of each of the plurality of terminal members.

10. The LED optical unit according to claim 9, wherein each cable connecting portion of the connector is directly connected to a cable.

11. The LED optical unit according to claim 9, further comprising:

guide surfaces located between each of the insert slits of the heat shield plate and each of the lock grooves of the heat shield plate, wherein each of the guide surfaces is slanted toward a respective one of the lock grooves.

12. The LED optical unit according to claim 10, further comprising:

guide surfaces located between each of the insert slits of the heat shield plate and each of the lock grooves of the heat shield plate, wherein each of the guide surfaces is slanted toward a respective one of the lock grooves

13. The LED optical unit according to claim 11, wherein a portion of each of the insert slits of the printed circuit board and the heat shield plate located adjacent to each of the guide surfaces is larger than the engaging portion of the connector so that each engaging portion of the connector can be removed from each of the insert slits of the printed circuit board and the heat shield plate.

14. The LED optical unit according to claim 13, wherein each of the insert slits of the printed circuit board and the heat shield plate is formed in a substantially arc shape.

15. The LED optical unit according to claim 9, wherein the cable connecting portion of the connector is a terminal for detecting an LED drive current.

16. The LED optical unit according to claim 10, wherein the cable connecting portion of the connector is a terminal for detecting an LED drive current.

17. A vehicle lamp including the LED optical unit according to claim 1, further comprising:

a housing; and an outer lens located adjacent to the housing.

18. A vehicle headlight including the LED optical unit according to claim 9, further comprising:

a housing; and an outer lens located adjacent to the housing.

19. The vehicle lamp including the LED optical unit according to claim 17, further comprising:

a fulcrum shaft having a fulcrum point located in the housing and configured such that the LED optical unit is revolvable about the fulcrum point; and a first screw configured to rotate the LED optical unit in a first direction about the fulcrum point and a second screw configured to rotate the LED optical unit in a second direction about the fulcrum point, the first direction being substantially normal to the second direction.

20. The vehicle headlight including the LED optical unit according to claim 18, further comprising:

a fulcrum shaft having a fulcrum point located in the housing and configured such that the LED optical unit is revolvable about the fulcrum point; and a first screw configured to rotate the LED optical unit in a first direction about the fulcrum point and a second screw configured to rotate the LED optical unit in a second direction about the fulcrum point, the first direction being substantially normal to the second direction.

* * * * *